US005870905A

United States Patent [19]

Imamura et al.

[11] Patent Number: 5,870,905

[45] Date of Patent: Feb. 16, 1999

[54] DRUM TYPE WASHING MACHINE AND WASHING METHOD THEREOF

[75] Inventors: Fumihiro Imamura; Katsuhei Kabeya; Masanori Niwa; Shojiro Sato, all of Tokyo, Japan

[73] Assignee: Kabushiki Kaisha Toshiba, Kawasaki, Japan

[21] Appl. No.: 628,916

[22] Filed: Apr. 8, 1996

[30] Foreign Application Priority Data

May 12, 1995 [JP] Japan ..... 7-114474

[51] Int. Cl.[6] ..... D06F 33/02

[52] U.S. Cl. ..... 68/12.04; 68/12.21; 68/24

[58] Field of Search ..... 8/158, 159; 68/902, 68/207, 24, 58, 140, 12.03, 12.04, 12.21

[56] References Cited

U.S. PATENT DOCUMENTS

| | | | |
|---|---|---|---|
| 3,388,410 | 6/1968 | Marshall | 8/158 |
| 4,446,706 | 5/1984 | Hartwig | 68/140 |
| 4,734,949 | 4/1988 | Yamakawa et al. | 8/159 |
| 4,765,160 | 8/1988 | Yamamoto et al. | 68/12.03 |
| 4,916,768 | 4/1990 | Broadbent | 8/159 |
| 4,987,627 | 1/1991 | Cur et al. | 8/159 |
| 5,133,200 | 7/1992 | Tanaka et al. | 68/12.03 |
| 5,263,215 | 11/1993 | Moon | 8/159 |
| 5,335,524 | 8/1994 | Sakane | 68/12.04 |
| 5,507,054 | 4/1996 | Blauert et al. | 68/12.04 |
| 5,560,061 | 10/1996 | Wentzlaff | 8/159 |
| 5,606,877 | 3/1997 | Hashimoto | 26/12.04 |

FOREIGN PATENT DOCUMENTS

| | | |
|---|---|---|
| 0 159 204 | 10/1985 | European Pat. Off. . |
| 0 373 063 | 6/1990 | European Pat. Off. . |
| 0 618 323 | 10/1994 | European Pat. Off. . |
| 1 418 870 | 7/1964 | France . |
| 4-336097 | 11/1992 | Japan . |

*Primary Examiner*—Frankie L. Stinson
*Attorney, Agent, or Firm*—Foley & Lardner

[57] ABSTRACT

A drum type washing machine operates based on two washing processes. In the first process, a drum-shaped spin basket is rotated by 50 R.P.M. in forward and backward directions. Next, in the second process, the spin basket is rotated by 300 R.P.M. during about 20 seconds. Thereby, washing water contained in textiles is dewatered to outside of the spin basket. These first and second processes are repeatedly by specified times.

10 Claims, 14 Drawing Sheets

WASHING OPERATION PROCESS OF A DRUM TYPE WASHING MACHINE

FIRST TYPE WASHING PROCESS
SECOND TYPE WASHING PROCESS

FIRST TYPE WASHING PROCESS, SECOND TYPE WASHIG PROCESS
WASHING TIME

CIRCULATION PUMP CONTROL SIGNAL

CIRCULATION PUMP CONTROL SIGNAL

CIRCULATION PUMP CONTROL SIGNAL

CONTROL SIGNAL FOR DRAIN VALVE 14

CONTROL SIGNAL FOR CIRCULATION PUMP 111

DRUM TYPE WASHING MACHINE AND WASHING METHOD THEREOF

BACKGROUND OF THE INVENTION

1. Field of the Invention

The present invention relates to a drum type washing machine and a washing method of washing textiles such as soiled textiles or washing to be cleaned by rotating or spinning a drum-shaped spin basket (or a rotatable type basket) placed in a washing tub, which are also placed in horizontal direction in the drum type washing machine.

2. Description of the Prior Art

Many conventional drum type washing machines operate based on a washing method (hereinafter referred to as "a first type washing method or a first type washing process") in order to wash soiled textiles, dirty cloths or washing. In the first type washing method or process in the conventional drum type washing machines, soiled textiles or dirty washing are put in a drum-shaped spin basket such as a rotatable horizontal washing drum which is mounted in a washing tub having washing water containing laundry detergent, both the drum-shaped spin basket and the washing tub are placed in horizontal direction in the drum type washing machine, and the soiled textiles are rotated in the drum-shaped spin basket. In more detailed, during the first type washing processes, the drum-shaped spin basket is spun or rotated in a forward direction and a reversed direction by a speed of rotation of approximately 50 R.P.M. during a predetermined time period. In the first type washing process, the soiled textiles are lifted and then fallen repeatedly into the washing water including the laundry detergent at the bottom of the drum-shaped spin basket in the washing tub every rotation in order to clean the soiled textiles.

One of the literatures, the Japanese laied-open publication of the application No. 4-336097, discloses a washing method in which a drum type washing machine controls the rotation speed of a drum-shaped spin basket in order to increase the washing detergency so that the soiled textiles or dirty washing are stuck to the inner wall of the drum-shaped spin basket and lifted to the maximum height in the drum-shaped spin basket.

However, because the conventional drum type washing machine washes soiled textiles or dirty cloths based on only the first type washing process described above by falling down them into the washing water in which laundry detergent such as a washing liquor or a washing powder is dissolved, it is difficult to obtain the same level of a washing detergency obtained by fully automatic washing machines which wash soiled textiles based on the a washing method in which the soiled textiles or dirty cloths are rotated in the washing water in which the whole of the soiled textiles are immersed, not the soiled textiles are fallen down from the top side to the bottom side of the drum-shaped spin basket. In addition, when the temperature of the washing water is low, the washing detergency of the drum type washing machine becomes lower and it must require a long time period in order to clean completely the soiled textiles. These are problems.

SUMMARY OF THE INVENTION

An object of the present invention is to provide a drum type washing machine and a washing method which are capable of washing efficiently soiled textures or dirty cloths with a highly washing detergency in a short washing time period.

In addition, another object of the present invention is to provide a drum type washing machine which is capable of performing washing process with lower sound or noise and lower vibration. The present invention is invented in order to achieve these objects described above.

In accordance with one aspect of the present invention, there is provided a washing method of drum type washing machines, which comprises: a washing water supplying step for supplying washing water in which laundry detergent is dissolved to soiled textiles to be cleaned placed in a rotary type spin basket having a plurality of small-sized holes on inner wall of the rotary type spin basket; a first type washing step for rotating the textiles containing the washing water and for falling down the soiled textiles into the washing water in the rotary type spin basket every rotation; and a second type washing step for rotating the soiled textiles by a rotation speed so that the washing water contained in the textiles is separated and dewatered into outside of the rotary type spin basket through the plurality of small-sized holes by a centrifugal force generated by the rotation of the rotary type spin basket, wherein the first type washing step and the second type washing step are repeatedly during a predetermined time period.

Thus, after supplying the washing water in which the laundry detergent is dissolved to the soiled textiles in the rotary-type spin basket, the washing detergency level can be increased by performing the first type washing step and the second type washing step repeatedly during a specified time period.

In accordance with another aspect of the present invention, there is provided a drum-type washing machine comprising: a washing tub for containing fresh water or washing water in which a laundry detergent is dissolved; a drum-shaped spin basket for washing soiled textiles to be cleaned which is put in the drum-shaped spin basket which is located in the washing tub, having a plurality of small-sized holes on the inner wall of the drum-shaped spin basket, having a rotatable horizontal axis and a part of the drum-shaped spin basket being soaked in the washing water in the washing tub; dewater means for dewatering the washing water in the soiled textiles by a centrifuge force generated by the rotation of the drum-shaped spin basket into the washing tub which being in outside of the drum-shaped spin basket through the plurality of small-sized holes; and washing control means for controlling the operation of the dewater means so that the operation of the dewater means is performed repeatedly during a predetermined time period.

Thus, the washing control means controls the rotation of the drum-shaped spin basket and the dewater means so that the drum-shaped spin basket is spun by a rotation speed of more than an angular speed by which the washing water contained in the soiled textiles are separated and dewatered to outside of the dram-shaped spin basket through the small-sized holes.

In accordance with another aspect of the present invention, there is provided a drum-type washing machine comprising: a washing tub for storing fresh water or washing water in which a laundry detergent be dissolved; a drum-shaped spin basket for washing textiles to be cleaned which being put in the drum-shaped spin basket which is located in the washing tub, having a plurality of small-sized holes in the inner wall of the drum-shaped spin basket, having a rotatable horizontal axis and a part of the drum-shaped spin basket being soaked in the washing water in the washing tub; first type washing control means for controlling a first type washing operation during a predetermined time period in which the textiles containing the washing water are fallen down into the washing water and into the inner wall of the drum-shaped spin basket every rotation of the drum-shaped spin basket; and second type washing control means for controlling a second type washing operation during a predetermined time period in which the drum-shaped spin basket is rotated or spun by a rotation speed more than the rotation speed used in the first type washing operation so that the washing water in the washing are separated and dewatered into the washing tub of the outside of the drum-shaped spin basket through the plurality of small-sized holes.

Thus, in the drum-type washing machine, the drum-shaped spin basket is spun by a predetermined rotation speed in a forward direction and a reversed direction in order to perform the first type washing operation under the control of the first type washing control means and is also spun under the control of the second type washing control means by a rotation speed having an angular speed to separate the washing water from the washing, which is more than the rotation speed used in the first type washing operation so that the washing water in the textiles are separated and dewatered to outside of the drum-shaped spin basket.

In addition, the drum type washing machine of the present invention described above further comprises a textile amount detection means for detecting an amount of the textiles in the drum-shaped spin basket and a rotation number changeable control means for indicating the change of the number of the rotation of the drum-shaped spin basket to the second type washing control means based on the textile amount detected by the textile amount detection means. In this case, the number of the rotation of the drum-shaped spin basket is controlled and changed based on the textile amount detected by the textile amount detection means.

Moreover, the drum type washing machine of the present invention described above, further comprises rotation number increasing means for gradually increasing the rotation member of the drum-shaped spin basket from the rotation number used in the first type washing operation up to the number of the rotation used in the second type washing operation. Thus, the rotation number of the drum-shaped spin basket is gradually increased during the transition state from the first type washing operation to the second type washing operation.

In addition, the drum type washing machine of the present invention described above, further comprises temperature detection means for detecting a temperature of the washing water in the washing tub and washing number changeable control means for changing the number of washing operations by the second type washing operation based on the temperature of the washing water detected by the temperature detection means.

In this case, the number of the washing operations performed by the second type washing operation is changed based on the temperature of the washing water detected by the temperature detection means.

Furthermore, the drum type washing machine of the present invention described above, further comprises washing number decreasing control means for decreasing the washing times performed by the second type washing operation when the temperature of the washing water is higher than a predetermined temperature or for performing the washing operation of the first type washing operation and for stopping the washing operation by the second type washing operation.

Thus, when the temperature of the washing water is higher than a predetermined temperature, the numbers of the washing processes performed by the second type washing operation is decreased than specified washing times or the execution of the operation of the second type washing process is stopped. When the execution of the second type washing operation is stopped, the first type washing operation is only performed.

In addition, the drum type washing machine of the present invention described above further comprises circulation means comprising at least a circulation pump and a circulation pipe for circulating the washing water from the bottom side of the washing tub to the top side of the washing tub and circulation control means for controlling the operation of the circulation means so that the washing water is circulated by the circulation means during the washing operation by the second type washing operation.

Thus, the washing water is circulated during the second type washing operation by the circulation means under the control of the circulation control means.

Moreover, the drum type washing machine of the present invention described above further comprises intermittent control means for controlling the circulation control means so that the washing water is circulated intermittently. Namely, the circulation of the washing water is circulated intermittently.

In addition, the drum type washing machine of the present invention described above further comprises circulation delay control means for controlling the operation of the circulation control means so that the circulation of the washing water is initiated after a predetermined time from the start of the second type washing operation. Namely, the circulation of the washing water is initiated after a predetermined time from the start of the second type washing operation.

In addition, the drum type washing machine of the present invention described above further comprises a supplementary tank for storing temporarily a part of the washing water in the washing tub and washing water transfer control means for transferring the part of the washing water in the washing tub into the supplementary tank during the second type washing operation by the second type washing control means.

Thus, the second type washing operation is performed efficiently by transferring a part of the washing water into the supplementary tank in the washing tank during the second type washing operation.

In accordance with another aspect of the present invention, there is provided a drum-type washing machine comprising: a washing tub for storing fresh water or washing water in which a laundry detergent is dissolved; a drum-shaped spin basket for washing textiles to be cleaned which are put in the drum-shaped spin basket which is located in the washing tub, having a plurality of small-sized holes on the inner wall of the drum-shaped spin basket, having a rotatable horizontal axis and a part of the drum-shaped spin basket being soaked in the washing water in the washing tub; first type washing control means for controlling a first type washing operation during a predetermined time period in which the textiles containing the washing water being fallen down into the washing water by gravity and into the inner wall of the drum-shaped spin basket every rotation of the drum-shaped spin basket; loosing control means for loosing the textiles uniformly in the drum-shaped spin basket by rotating the drum-shaped spin basket irregularly against the rotation in the second type washing operation after the first type washing operation performed by the first type washing control means; and second type washing control means for controlling a second type washing operation during a predetermined time period in which the drum-shaped spin basket being rotated or spun by a rotation speed more than the rotation speed used in the first type washing operation so that the washing water contained in the soiled textiles are separated and dewatered into the washing tub of the outside of the drum-shaped spin basket through the plurality of small-sized holes.

Thus, the first type washing operation is performed by rotating the drum-shaped spin basket a predetermined rotation times in a forward direction and a backward direction repeatedly. After the completion of the first type washing operation, the loosing operation is performed in order to loosing and dispersed the washing uniformly in the drum-shaped spin basket by controlling the rotation of the drum-shaped spin basket. Finally, after the loosing operation is completed, the second type washing operation is performed by rotating the drum-shaped spin basket with the rotation speed which is higher than the rotation speed used in the first type washing operation and more than an angular speed by which the washing water in the textiles is separated and dewatered into the outside of the drum-shaped spin basket through the small-sized holes by gravity.

In addition, the drum type washing machine of the present invention described above further comprises separation control means for separating the textiles from the inner wall of the drum-shaped spin basket by rotating the drum-shaped spin basket with a rotation speed which is lower than the rotation speed used in the first type washing operation after the second type washing operation executed by the second type washing control means is completed.

Namely, after the second type washing operation is completed, the drum-shaped spin basket is rotated with the rotation speed which is lower than the rotation speed used in the first type washing operation so that the textiles is separated from the inner wall of the drum-shaped spin basket.

These and other objects, features, aspects and advantages of the present invention will become more apparent from the following detailed description of the present invention when taken in conjunction with the accompanying drawings.

DESCRIPTION OF THE PREFERRED EMBODIMENTS

Hereinafter, drum type washing machines of preferred embodiments of the present invention will be explained with reference to drawings.

First Embodiment 1

Figure 1:
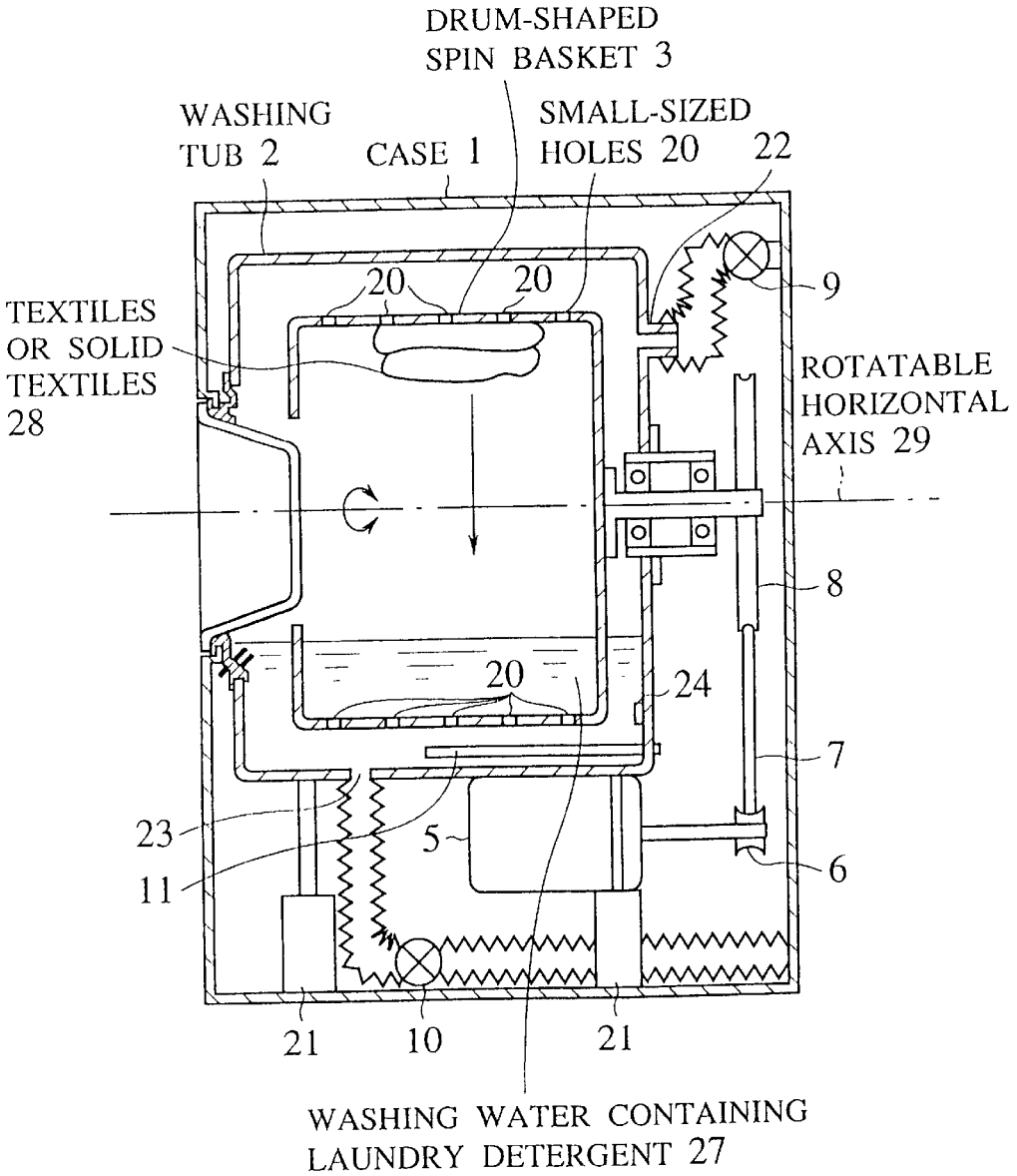
FIG. 1 is a sectional diagram showing a configuration of a drum type washing machine as the first embodiment of the present invention.

FIG. 1 is a sectional diagram showing a configuration of a drum type washing machine as the first embodiment of the present invention.

The drum type washing machine shown in FIG. 1 comprises a washing tub 2 mounted in the inner side of an outer casing or a case 1 for storing washing water 27 in which a laundry detergent is dissolved and a drum-shaped spin basket 3 located in the washing tub 2. Textiles or washing such as soiled textiles or dirty clothes in the drum-shaped spin basket 3 are washed by rotating or spinning the drum-shaped spin basket 3 around the rotatable horizontal axis 29 of it. The washing tub 2 is fixed on the bottom side of the case 1 by base components 21 through support members.

The drum-shaped spin basket 3 has an opening and closing door 4 located at the front side of the case 1 (see the reference number 4 at the left side in FIG. 1).

Textiles 28 are put into the inside of the drum-shaped spin basket 3 when the opening and closing door 4 is open. The rotatable horizontal axis 29 of the drum-shaped spin basket 3 is placed at the center of a drum pulley 8. A belt is connected between the drum pulley 8 and a pulley 6 at the bottom side of the case 1. The pulley 6 is connected to a driving axis of a motor 5 placed at the lower side of the washing tub 2. Thereby, the rotation of the motor 5 is transmitted to the drum-shaped spin basket 3 through the pulley 6, the belt 7 and the drum pulley 8, so that the drum-shaped spin basket 3 is spun. The drum-shaped spin basket 3 has a plurality of small-sized holes 20 on the inner wall of the drum-shaped spin basket 3. The washing water contained in the textiles 28 are separated and dewatered through the small-sized holes 20 to the outside of the drum-shaped spin basket 3 and to the washing tub 2 by a centrifugal force generated by the rotation of the drum-shaped spin basket 3.

A fresh water supply inlet 22 is formed in the top side of the case 1 above the washing tub 2. The fresh water supply inlet 22 is connected to a water supply valve 9 through a water pipe in order to supply water or fresh water into the washing tub 2 and the drum-shaped spin basket 3. In addition, a drain outlet or a drain outlet 23 is formed at the bottom side of the washing tub 2 and the drain outlet 23 is connected to a drain valve or a drain valve 10 through a pipe. The washing water 27 in the washing tub 2 is drained to the outside of the drum type washing machine through a drain pipe.

In addition, a temperature sensor 24 for detecting a temperature of the washing water 27 is incorporated at the inner wall of the bottom side of the washing tub 2. A heater 11 for heating the washing water 27 is placed at the bottom side of the washing tub 2.

Figure 2:
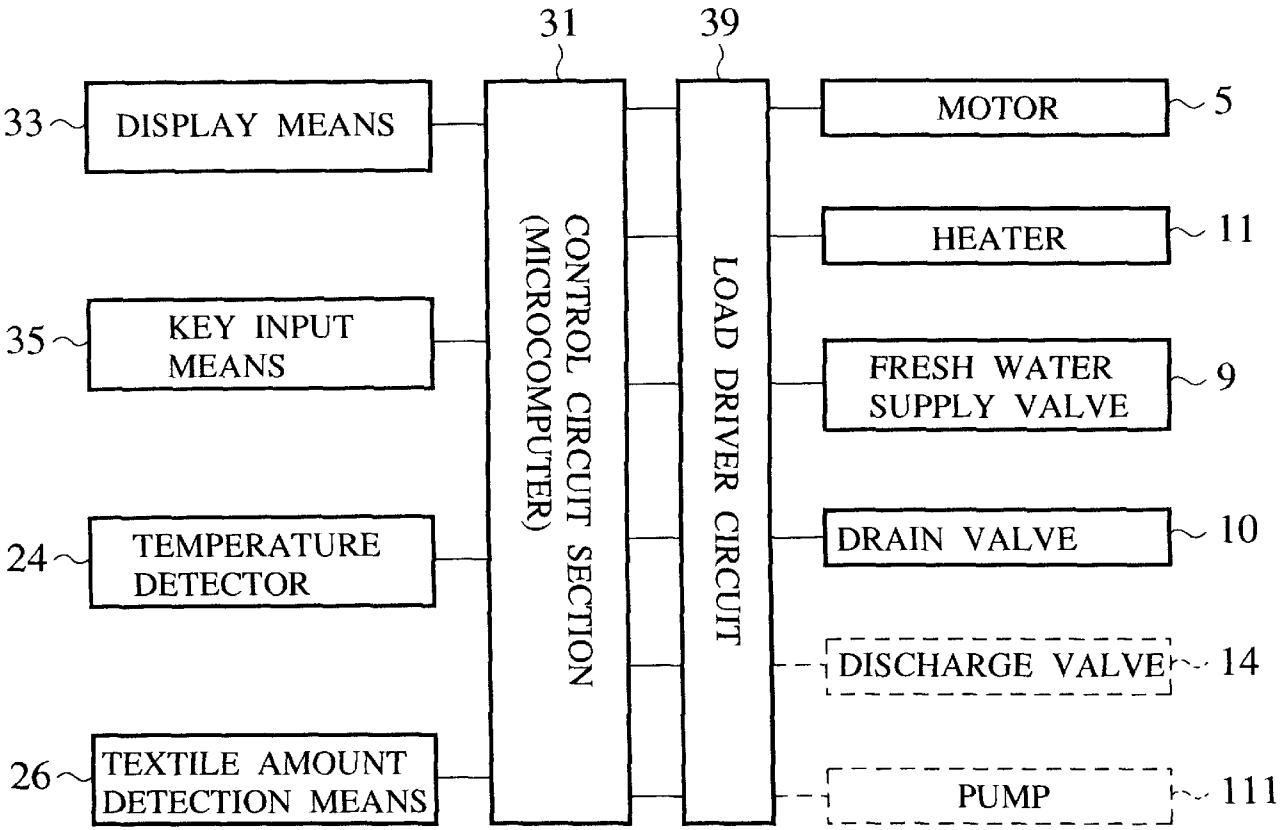
FIG. 2 is a block diagram showing a circuit configuration of the drum type washing machine of the first embodiment as shown in FIG. 1.

FIG. 2 is a block diagram showing a circuit configuration of the drum type washing machine of the first embodiment as shown in FIG. 1.

As shown in FIG. 2, the drum-shaped washing machine has a microcomputer as a control circuit section 31. The control circuit section 31 controls suitably the operations of the motor 5, the heater 11, the fresh water supply valve 9, the drain or the drain valve 10, and a cloth amount detection means 26 (whose operation will be described later) through a load driver circuit 39.

In addition, the control circuit section 31 is connected to a display means for displaying a state of a power source ON state and operation states of the drum-shaped washing machine, a key input means 35 for switching the ON/OFF state of the drum-shaped spin basket 3 and for receiving information used to control of the washing tub 2, the temperature detector 24, and the textile amount detection means 26 in order to receive various type information data items from them.

Although a load driver circuit 39 is placed between the control circuit section 31, the drain valve 14 and the circulation pump 111 as shown in FIG. 2, the control circuit section 31, the drain valve 14 and the circulation pump 111 are used for embodiments which will be described later.

Next, the operation of the drum type washing machine of the first embodiment will be explained with reference to FIGS. 1 to 6.

Figure 3:
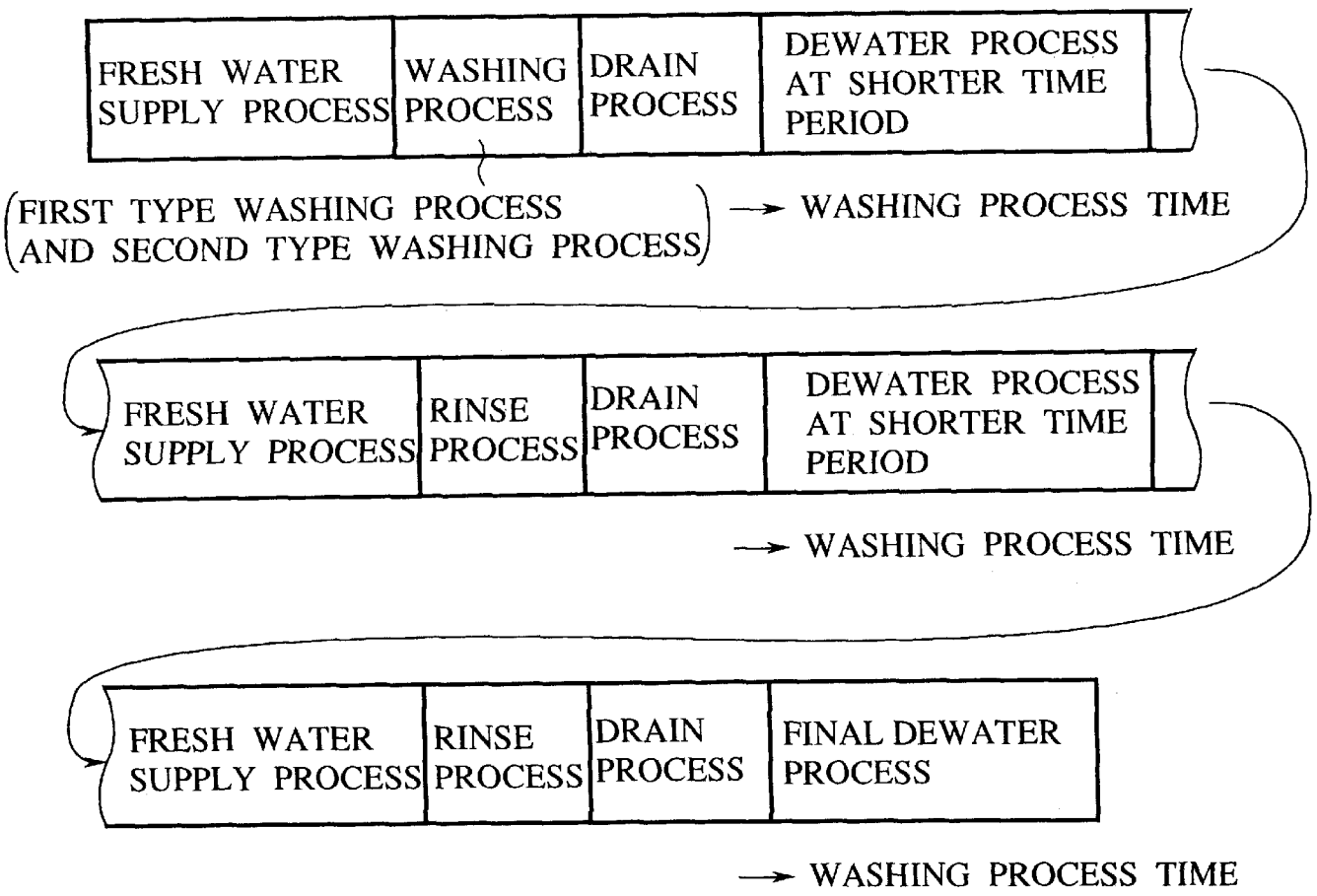
FIG. 3 is operational steps of the drum type washing machine of the first embodiment as shown in FIGS. 1 and 2.

FIG. 3 is operational steps of the drum type washing machine of the first embodiment as shown in FIGS. 1 and 2.

As shown in FIG. 3, under the control of the control circuit section 31 such as a microcomputer, the drum type washing machine of the first embodiment performs basically a washing operation including three washing process in order. In the first washing process comprises a fresh water supply process, a washing process, a draining process, and a dewater process in a short time period. In the second washing process comprises a fresh water supply process, a rinse process, a draining process, and a dewater process in a short time period. The final washing process comprises a fresh water supply process, a rinse process, a draining process, and a final drain process or a final drain process.

The washing operation of the drum type washing machine of the first embodiment will be explained in more detail.

An operator operates the key input means 35, then the washing operation of the drum type washing machine is initiated. The fresh water supply valve 9 is open, and then the washing water 27 containing fresh water such as service water is supplied through the fresh water supply valve 9 to the washing tub 2. The washing water supply is continued until a predetermined amount of the fresh water is supplied into the washing tub 2 under the control of a water position level detection sensor (not shown). Thereby, the fresh water supply process is completed.

After the fresh water supply process is completed, the washing operation is initiated.

Figure 4:
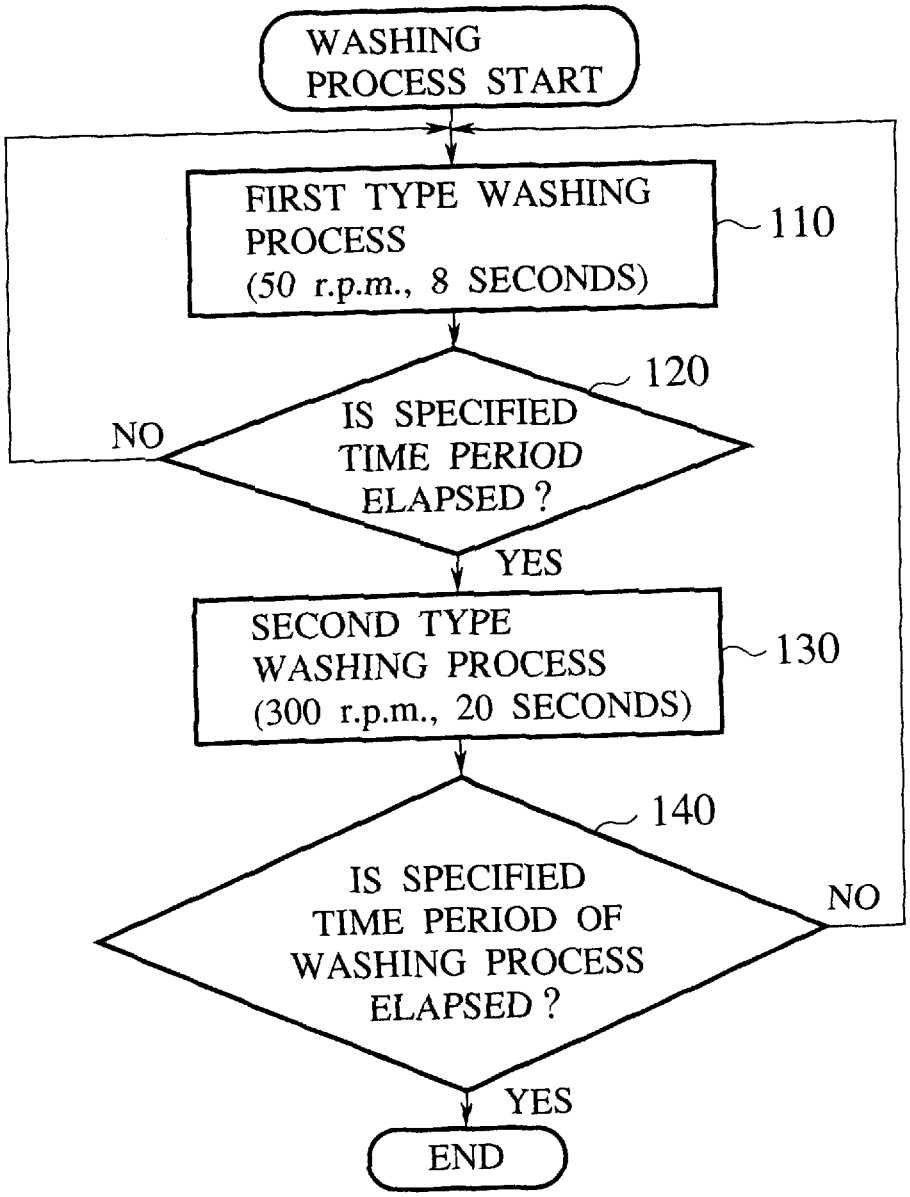
FIG. 4 is a flow chart showing the operation of the drum type washing machine of the first embodiment as shown in FIGS. 1 and 2.

The washing process performed by the drum type washing machine of the first embodiment has basically two washing type processes, the first type washing process and the second type washing process, as shown in FIG. 4. The washing process as the combination of the first type washing process and the second type washing process is one of the important features of the present invention.

FIG. 4 is a flow chart showing the operation of the drum type washing machine of the first embodiment as shown in FIGS. 1 and 2.

In the washing process in the drum type washing machine of the first embodiment of the present invention, at first, the first type washing process is performed during a specified time period. In the first type washing process, the soiled textiles 28 are lifted and then fallen repeatedly into the washing water 27 including the laundry detergent at the bottom of the drum-shaped spin basket 3 in the washing tub 2 every rotation in order to clean the soiled textiles 28 (Step 110 and Step 120).

Figure 5:
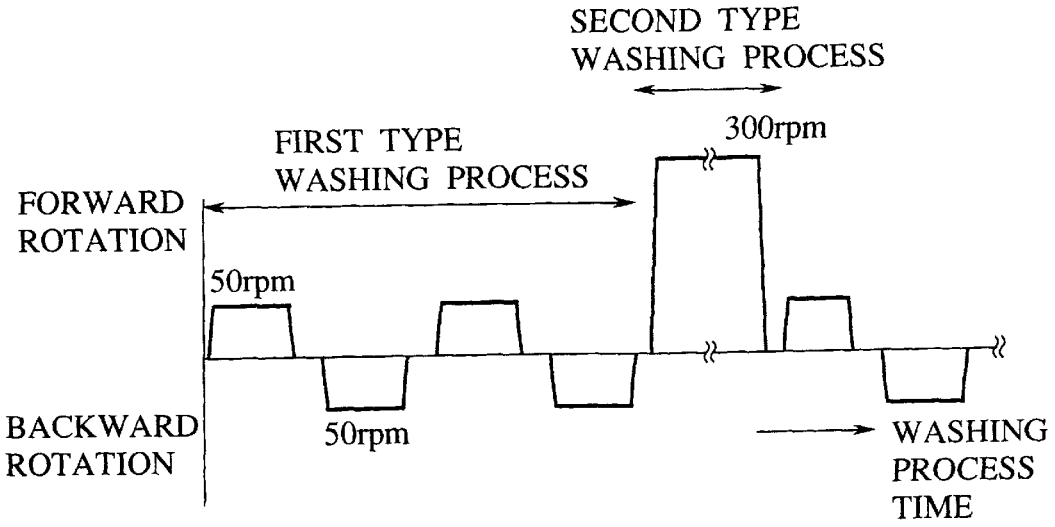
FIG. 5 is a diagram showing the relationship between the operation timing of the drum type washing machine shown in FIG. 4 and the rotation numbers of the drum-shaped spin basket.

FIG. 5 is a diagram showing the relationship between the operation timing of the drum type washing machine shown in FIG. 4 and the rotation numbers of the drum-shaped spin basket.

In the first type washing process, as shown in the first half of FIG. 5, the drum-shaped spin basket 3 is rotated at the rotation speed of 50 R.P.M. during 8 seconds in the forward rotation direction, the rotation of the drum-shaped spin basket 3 is stopped, and then, the drum-shaped spin basket 3 is rotated at the rotation speed of 50 R.P.M. during 8 seconds in the backward rotation direction, and the rotation of it is stopped by the motor 5 under the control of the control circuit section 31. In the first type washing process, the textiles 28 in the drum-shaped spin basket 3 are lifted up to the top section of the inner wall of the drum-shaped spin basket 3 and fallen into the bottom section of the spin basket 3 every rotation by gravity.

After the first type washing process is completed, the second type washing operation is initiated under the control of the control circuit section 31. In the second type washing process, the drum-shaped spin basket 3 is rotated at the 300 R.P.M. during approximately 20 seconds by the motor 5 (Step 130) in order to dewater the washing water 27 containing the textiles 28 in the drum-shaped spin basket 3. The rotation speed (300 R.P.M.) used in the second type washing process is about six times of the rotation speed (50 R.P.M.) used in the first type washing process, as shown in the later half in FIG. 5.

During the second type washing process, the textiles 28 is pushed on the inner wall of the drum-shaped spin basket 3 by centrifugal force generated by the rotation of the drum-shaped spin basket 3. The washing water 27 contained in the textiles 28 is separated and dewatered from the textiles 28 to the outside of the drum-shaped spin basket 3 through the small-sized holes 20 by centrifugal force. Namely, the washing water 27 contained in the textiles 28 are wrung out. Thereby, the washing detergency of the drum type washing machine of the first embodiment can be increased rather than that of the prior art.

When the second type washing process is completed, it is checked whether or not the specified washing time period has been elapsed (Step 140). The washing process flow is returned to the step 110 when the specified washing process time period does not elapsed and the first type washing process is initiated again.

In the first type washing process, the textiles 28 are lifted to and pushed on the inner wall of the drum-shaped spin basket 3 by centrifugal force caused by the rotation. Then, the textiles 28 are fallen into the washing water 27 in the drum-shaped spin basket 27 and to the bottom section of the drum-shaped spin basket 3 every rotation by gravity. The position of the textiles 28 are changed in the drum-shaped spin basket 3 every rotation. After the washing time period for the first type washing process is elapsed (Step 120), the second type washing process is initiated again. Thus, the combination (Step 110 to Step 130) of the first type washing process and the second type washing process is repeated during a specified washing time period, for example, approximately 30 minutes.

After the washing process has been completed, the rotation of the drum-shaped spin basket 3 is stopped. Then, the draining process to drain the washing water 27 or water is initiated. In the draining process, the drain valve 10 is open and the washing water 27 in the washing tub 2 is drained to outside of the washing tub 2.

When the draining process is completed, the dewater process is performed in a short time period. After this, following processes as shown in FIG. 3 are performed.

Next, the operation of the second type washing process in the washing process will be explained in detail.

Specifically, the relationship between gravity and the number of rotation or the rotation speed used in the second type washing process will be explained.

When gravity G=mg and the centrifugal force generated by the rotation of the drum-shaped spin basket 3 $f=mr\omega^2$, we can define ω as follows when the centrifugal force F is equal to the gravitational acceleration:

$$\omega=(g/r)^{1/2}$$

where "r" is the radius of the drum-shaped spin basket 3.

We shows the number of the rotation of the drum-shaped spin basket 3 as follows:

$$n=(60/2\pi)\omega(\text{R.P.M.}).$$

When the radius "r" of the drum-shaped spin basket 3 is 0.22 meters, the number of rotation becomes n=63.7 (R.P.M.).

Because "n" is 50 R.P.M. during the first type washing process, we can obtain the magnitude of the centrifugal force "f" in the first type washing process as follows:

$$f=(50/63.7)^2\ g=0.62\ \text{g}.$$

In the first type washing process, the textiles 28 are pushed onto the inner wall of the drum-shaped spin basket 3 by the centrifugal force of 0.62 g and fallen to the bottom section of the drum-shaped spin basket 3 every rotation by gravity.

On the other hand, because "n" is 300 R.P.M. during the second type washing process, we can obtain the magnitude of the centrifugal force "f" in the second type washing process as follows:

$$f=(300/63.7)^2\ g=22.2\ \text{g}.$$

During the second type washing process, the textiles 28 are pushed onto the inner wall of the drum-shaped spin basket 3 every rotation with the centrifugal force of 22.2 g which is approximately 35 times of the centrifugal force of 0.62 g during the first type washing process. Thereby, the washing water contained in the textiles 28 are separated from the textiles 28 and dewatered to outside of the drum-shaped spin basket 3 through the plurality of small-sized holes 20.

Figure 6:
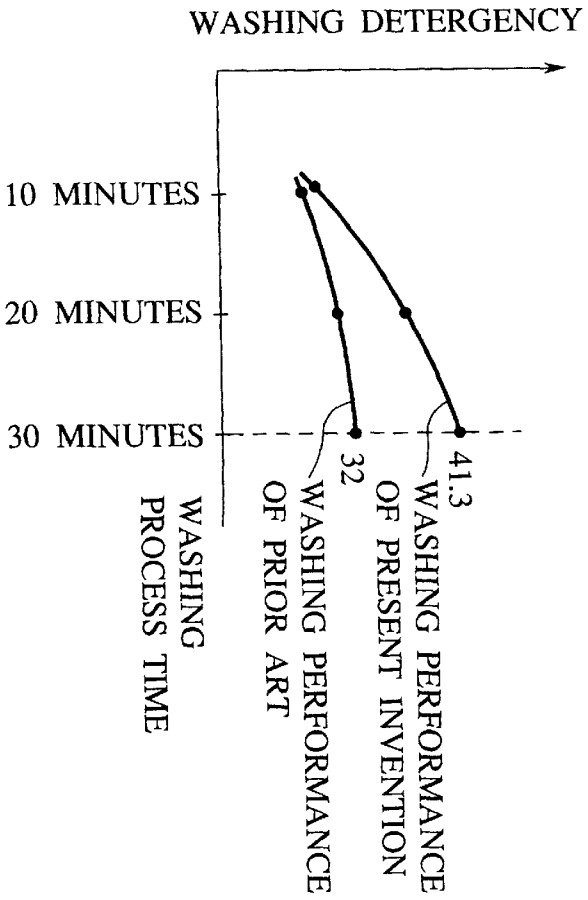
FIG. 6 is a diagram showing a comparison result between a washing performance to a washing time period of the drum type washing machine having a combination process of a first type washing process and a second type washing process of the first embodiment shown in FIGS. 1 and 2 and a washing performance to washing time period of a conventional drum type washing machine only performing the first type washing process.

FIG. 6 is a diagram showing a comparison result between the washing performance to washing time period of the drum type washing machine having a combination process of the first type washing process and the second type washing process of the first embodiment shown in FIGS. 1 and 2 and the washing performance to washing time period of the conventional drum type washing machine only performing the first type washing process.

As clearly shown in FIG. 6, when comparing with the washing detergency of the drum type washing machine of the prior art, the washing detergency of the drum type washing machine of the first embodiment according to the present invention is increased to approximately 13 percents. Specifically, the washing detergency of the drum type washing machine of the first embodiment becomes 41.3 (which is a significant high value) at the washing time of 30 minutes, on the other hand, the washing detergency of the prior art is 32. Furthermore, the reflection rate at the surface of normal soiled textiles is used as the detection method of the washing detergency after the washing process of the textiles 28 is completed.

Embodiment 2

Figure 7:
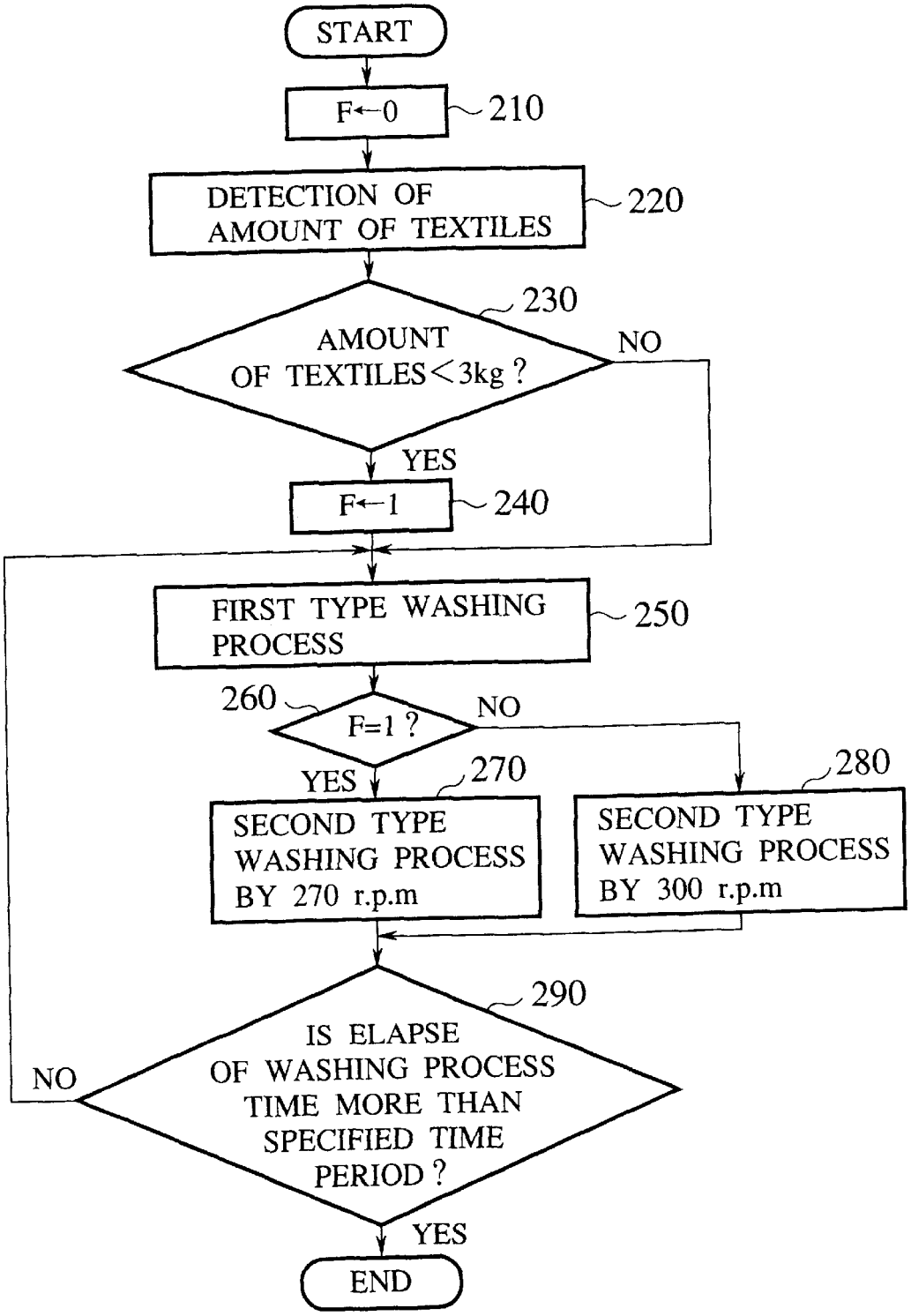
FIG. 7 is a flow chart of the operation of a drum type washing machine of the second embodiment of the present invention.

FIG. 7 is a flow chart of the operation of a drum type washing machine of the second embodiment of the present invention. We will use the reference numbers of the components in the drum type washing machine of the second embodiment, which are the same reference numbers of the same components used in the drum type washing machine of the first embodiment, as shown in FIGS. 1 and 2, in configuration and operation for brevity.

The feature of the drum type washing machine of the second embodiment shown in FIG. 7 is that a textile amount detection means 26 detects the amount of the textiles 28 in the drum-shaped spin basket 3 and the control circuit section 31 controls the number of the rotation or the rotation speed of the drum-shaped spin basket 3, during the second type washing process in the washing process which has been described in the description of the first embodiment, based on the detection result obtained by the textile amount detection means 26.

We will further explain the operation of the drum type washing machine of the second embodiment in detail.

In general, the radius of the rotation of each of the textiles 28 is changed based on the amount of the textiles in the drum-shaped spin basket 3. Namely, when the amount of the textiles 28 is large, the radius of the rotation of the textiles placed near the center of the rotation becomes small. Thus, even if the radius of the rotation of the textiles is changed, the centrifugal force of the textiles do not changed when the number of the rotation (or the rotation speed) of the textiles is shifted based on the square root of the radius. For example, when the radius of the rotation of the textiles is decreased by the 20 percents, the number of the rotation of the drum-shaped spin basket 3 may be increased by approximately 10 percents.

Thus, the drum type washing machine of the second embodiment decreases the number of the rotation of the drum-shaped spin basket 3 when the amount of the textiles is small and increases the rotation speed of it when the amount of the textiles is large.

In the flow chart shown in FIG. 7, the value of the flag F is set as zero (Step 210), the amount of the textiles 28 is detected (Step 220), it is detected whether or not the amount of the textiles is not greater than 3 kg. When the amount of the textiles 28 is not more than 3 kg, the value of the flag F is set to 1 (Step 240). Then, after the first type washing process is completed (Step 250) during the predetermined time period, the value of the flag "F" is checked. When the checked result is "1", because the amount of the textiles 28 is not greater than 3 kg, the rotation speed of the drum-shaped spin basket 3 is set as the 270 R.P.M., then the second type washing process is performed during a specified time period (Step 280). After the second type washing process is completed, the drum type washing machine checks whether or not the specified time period for the washing process has been elapsed (Step 290). When the elapse of the washing process time is not more than the specified time period, the operation flow is returned to the Step 250 and then the first type washing process and the second type washing process are performed in order. Finally, when the elapse of the washing process time becomes more than the specified time period, the washing process is completed.

Figure 8:
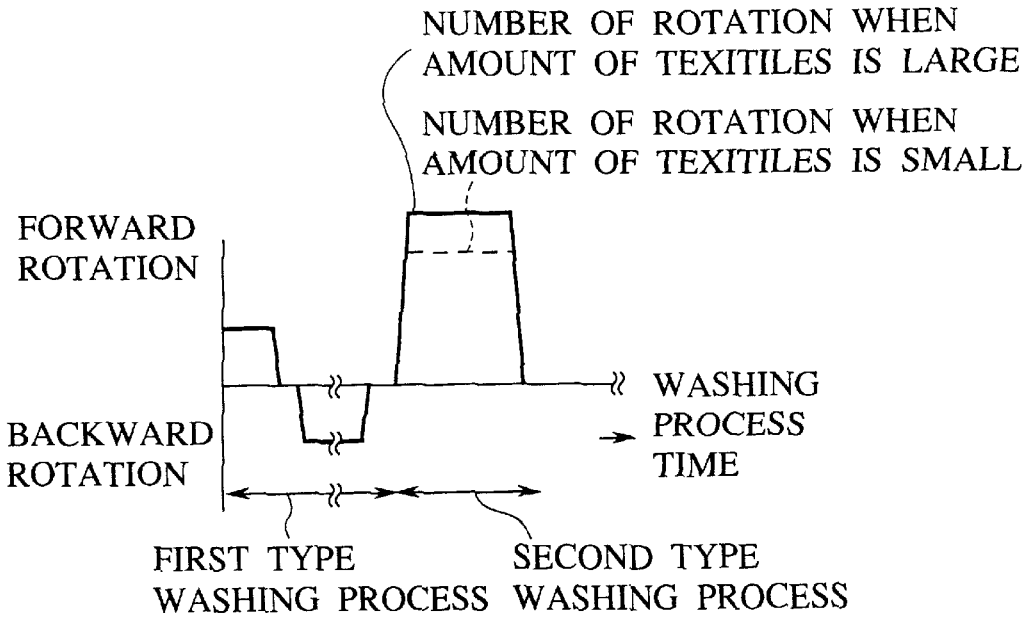
FIG. 8 is diagram showing the change of the number of the rotation of a drum-shaped spin basket based on the amount of textiles in a second type washing operation after a first type washing operation is completed in the drum type washing machine of the second embodiment shown in FIG. 7.

FIG. 8 is a diagram showing the change of the number of the rotation of the drum-shaped spin basket 3 according to the amount of textiles in the second type washing operation under the control of the control circuit section 31 after the first type washing operation is completed in the drum type washing machine of the second embodiment shown in FIG. 7.

Specifically, there are available various methods as the textile amount detection means 26. For example, one method is that the amount of the textiles is detected by the change of the number of the rotation of the motor 5 while the drum-shaped spin basket 3 is rotated. Another method is that the amount of the textiles is detected by the change of the current flow in the motor 5 during the drum-shaped spin basket 5 is rotated.

Embodiment 3

Figure 9:
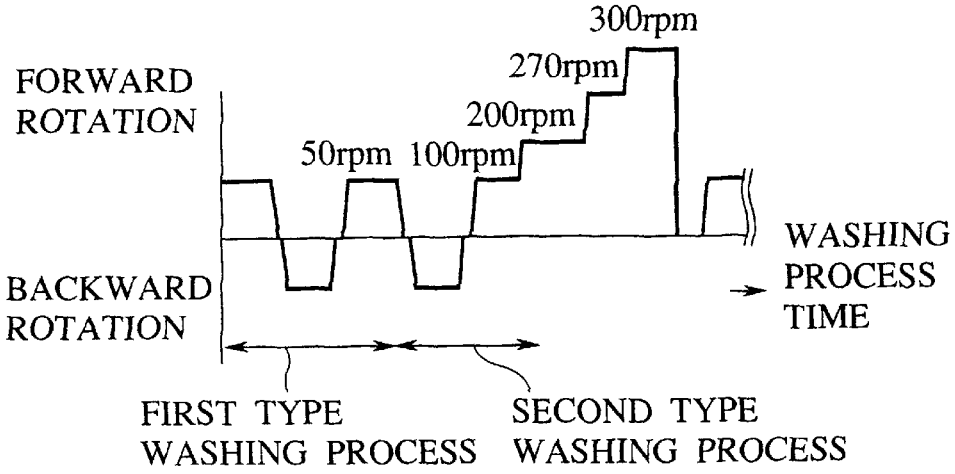
FIG. 9 is a diagram showing the operation of the drum type washing machine of the third embodiment of the present invention.

FIG. 9 is a diagram showing the operation of the drum type washing machine of the third embodiment of the present invention. We will use the reference numbers of the components in the drum type washing machine of the third embodiment, which are the same reference numbers of the same components used in the drum type washing machine of the first embodiment, as shown in FIGS. 1 and 2, in configuration and operation for brevity.

In the drum type washing machine of the third embodiment as shown in FIG. 9, the control circuit section 31 controls the number of the rotation (or the rotation speed) of the drum-shaped spin basket 3 during the second type washing process so that the rotation speed of it is shifted or gradually changed in order to reduce sound or noise and vibration of the drum type washing machine which is caused or generated by greatly changing of the number of rotation of the drum-shaped spin basket 3.

Specifically, because the number of the rotation of the drum-shaped spin basket 3 is extremely increased (for example from 50 R.P.M. to 300 R.P.M.) when the second type washing process is initiated from the first type washing process, the sound or noise and the vibration of the drum type washing machine become often large. In order to avoid this, as shown in FIG. 9, the rotation speed of the drum-shaped spin basket 3 is gradually changed, for example 100 R.P.M., 200 R.P.M. 270 R.P.M. and 300 R.P.M. in order after the first type washing process is completed and before the second type washing process is initiated under the control of the control circuit section 31.

In addition, in this case described above, it can be acceptable that the washing time period of the first type washing process is decreased from the 4 minutes to 3 minutes and 30 seconds, and the washing time period of the second type washing process is increased per 10 seconds. Thereby, it can be achieved to reduce the sound or noise and the vibration caused by the second type washing process without increasing the total washing time period including the first type washing process and the second type washing process and without decreasing the washing detergency during the second type washing process.

Embodiment 4

Figure 10:
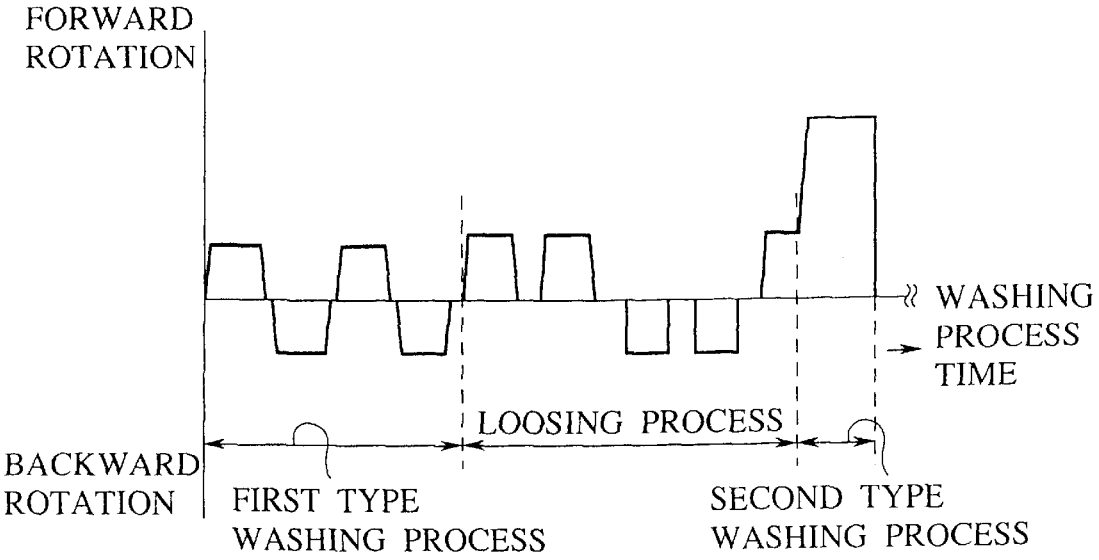
FIG. 10 is a timing chart showing the operation of a drum type washing machine of the fourth embodiment of the present invention.

FIG. 10 is a timing chart showing the operation of a drum type washing machine of the fourth embodiment of the present invention. We will use the reference numbers of the components in the drum type washing machine of the fourth embodiment, which are the same reference numbers of the same components used in the drum type washing machine of the first embodiment, as shown in FIGS. 1 and 2, in configuration and operation for brevity.

As shown in the timing chart of FIG. 10, in the drum type washing machine of the fourth embodiment, a loosing process is performed before the second type washing process and after the first type washing process under the control of the control circuit section 31. In order to loosing the textiles 28 in the drum-shaped spin basket 3, during the loosing process, the drum-shaped spin basket 3 is rotated irregularly in time and rotation speed when comparing with the rotation speed or the number of the rotation of the drum-shaped spin basket 3 used in a usual washing process. The loosing process comprises an interruption state in which the drum-shaped spin basket 3 is stopped and an irregular rotation state in which the drum-shaped spin basket 3 is rotated irregularly during irregular time period. The textiles 28 is distributed uniformly in position in the drum-shaped spin basket 3 after the loosing process is completed. Thereby, it can be achieved to reduce the noise or sound of the rotation of the drum-shaped spin basket 3 during the second type washing process.

In addition, the most suitable time period and the most optimum rotation speed for the loosing process is 2 minutes and the 45 R.P.M.

Embodiment 5

Figure 11:
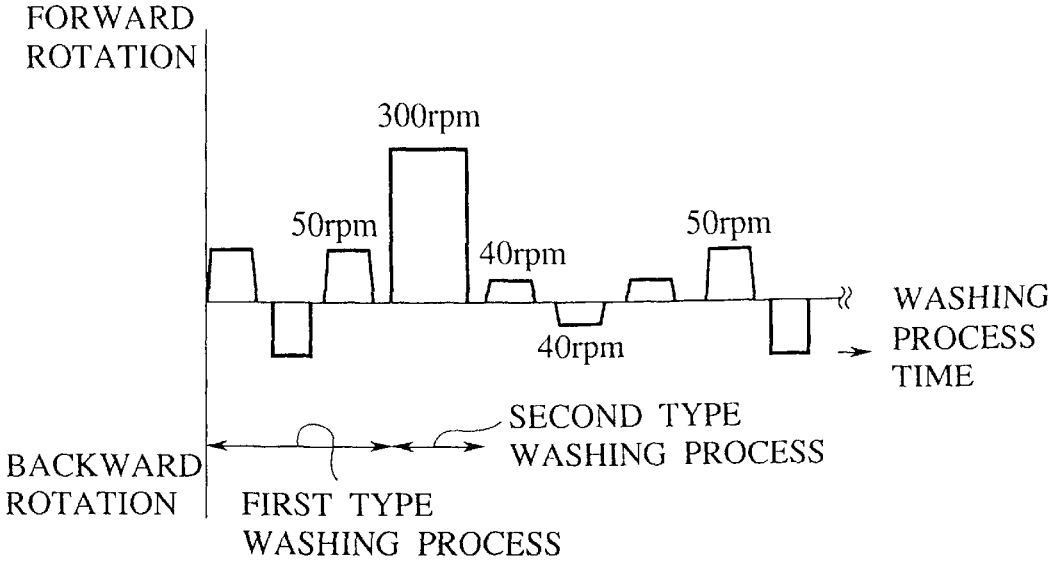
FIG. 11 is a timing chart showing the operation of a drum type washing machine of the fifth embodiment of the present invention.

FIG. 11 is a timing chart showing the operation of a drum type washing machine of the fifth embodiment of the present invention. We will use the reference numbers of the components in the drum type washing machine of the fifth embodiment, which are the same reference numbers of the same components used in the drum type washing machine of the first embodiment, as shown in FIGS. 1 and 2, in configuration and operation for brevity.

As shown in FIG. 11, in the drum type washing machine of the fifth embodiment, the drum-shaped spin basket 3 is rotated after the first type washing process and the second type washing process are completed, by the rotation speed of 40 R.P.M., for example, which is lower than the rotation speed (45 R.P.M.) used in the first type washing process under the control of the control circuit section 31. Thereby, the textiles 28 pushed onto the inner wall of the drum-shaped spin basket 3 by the centrifugal force caused by the rotation can be separated from the inner wall of the drum-shaped spin basket 3, so that the textiles 28 will be easily moved in the drum-shaped spin basket 3 in the following washing process, the washing process can be efficiently performed, and the washing detergency can be increased.

Embodiment 6

Figure 12:
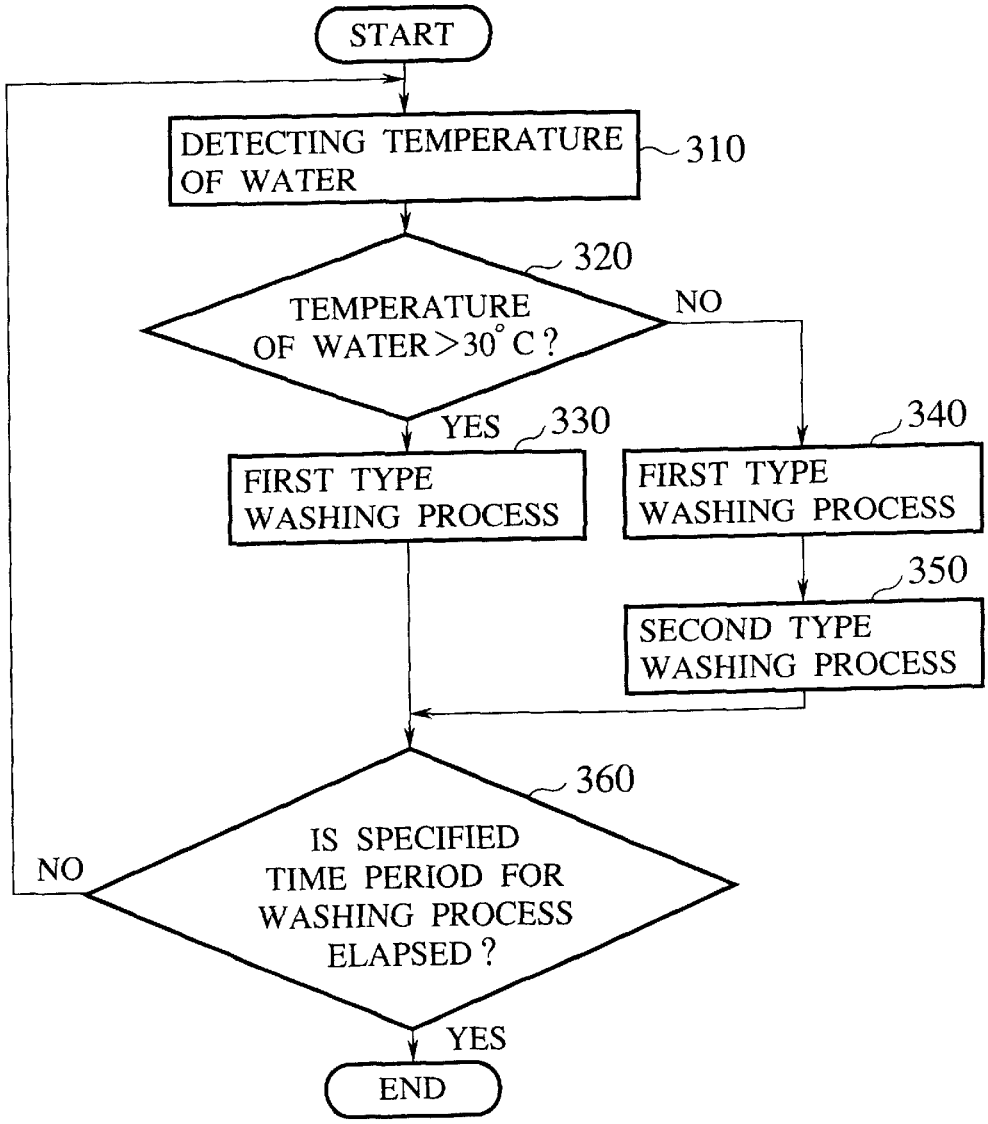
FIG. 12 is a flow chart showing the operation of a drum type washing machine of the sixth embodiment of the present invention.

FIG. 12 is a flow chart showing the operation of a drum type washing machine of the sixth embodiment of the present invention.

We will use the reference numbers of the components in the drum type washing machine of the sixth embodiment, which are the same reference numbers of the same components used in the drum type washing machine of the first embodiment, as shown in FIGS. 1 and 2, in configuration and operation for brevity.

In the drum type washing machine of the sixth embodiment, the temperature of the washing water 27 is detected by the temperature detector 24, as shown in FIG. 2. Then, one of the first type washing process or the combination of the first type washing process and the second type washing process is performed based on the temperature detection result under the control of the control circuit section 31.

In more detail, we will explain the operation of the drum type washing machine of the sixth embodiment.

When the temperature of the washing water 27 is relatively high, the control circuit section 31 indicates to operate the first type washing process by which the drum type washing machine has a relatively highly washing detergency.

On the other hand, for example, in a case that a hot water supply means (not shown) to supply hot water to the drum type washing machine must be used for the washing process when the temperature of the washing water is lower or in a case that the washing water 27 must be heated by the heater 11 incorporated in the drum type washing machine during the washing process in order to obtain a specified washing detergency, it is difficult to obtain a highly washing detergency when the first type washing process is only used. In these cases, because the temperature of the washing water 27 is lower, the combination of the first type washing process and the second type washing process must be used under the control of the control circuit section 31 in order to increase the washing detergency.

As shown in the flow chart in FIG. 12, firstly, the temperature detector 24 detects the temperature of the washing water 27 (Step 310), and then, it is detected whether or not the detected temperature is not less than 30° C. (Step 320). When the detected temperature of the washing water 27 is not more than 30° C., both the first type washing process and the second type washing process are performed under the control circuit section 31 (Step 340 and Step 350). On the other hand, when the detected temperature of the washing water 27 is not more than 30° C., the control circuit section 31 indicates to operate only the first type washing process (Step 330). These washing processes are completed after the washing process time is elapsed over the specified time period (Step 360).

In this case, it is also acceptable that both the first type washing process and the second type washing process are executed and the washing number of the second type washing process is decreased when the detected temperature is not less than 30° C.

As described above, the second type washing process is stopped or the number of the execution times of the second type washing process is decreased based on the detected temperature of the washing water 27, so that the noise or sound and the vibration caused by the washing process in the drum type washing machine can be decreased.

In general, because the temperature of the washing water 27 is changed in place or area, season, and time when washing process is performed in a day, it is very effective to increase the washing detergency by using the washing method controlled by the control circuit section 31 in the drum type washing machine of the sixth embodiment.

Figure 13:
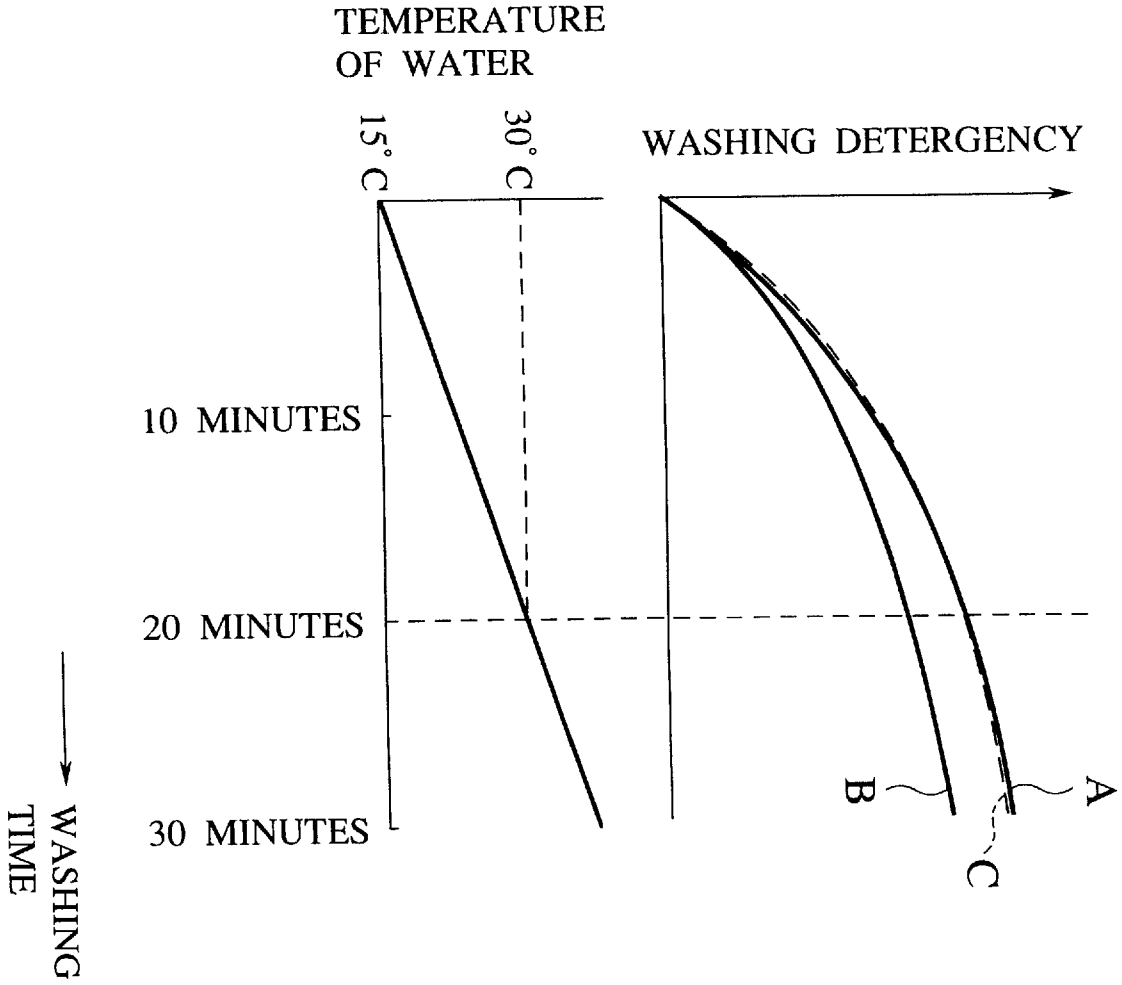
FIG. 13 is a diagram showing a cleaned degree of textiles when an electric heater of 1 kw is used in order to heat washing water in the drum type washing machine of the sixth embodiment shown in FIG. 12.

FIG. 13 is a diagram showing cleaned degree of textiles 28 when the electric heater of 1 kw (as the heater 11) is used in order to heat washing water 27 in the drum type washing machine of the sixth embodiment shown in FIG. 12.

In FIG. 13, the horizontal axis shows the washing time and the vertical axis shows the temperature of the washing water 27 and the washing detergency of the textiles 28.

FIG. 13 shows the characteristics of the washing detergency based on the three kinds of conditions such as the washing time, the temperature and the washing detergency.

In the first condition designated by the curve A, only the first type washing process is performed after the temperature of the washing water 27 becomes not less than 30° C. in which both the first type washing process and the second type washing process are performed.

In the second condition designated by the curve B, only the first type washing process is performed during the entire washing process.

In the third condition designated by the curve C, both the first type washing process and the second type washing process are performed during the entire washing process.

As clearly shown in FIG. 13, the washing detergency of each of the conditions A and C is approximately equal. On the other hand, the washing detergency of the condition C is lower than those of the conditions A and C.

When the temperature of the washing water 27 becomes high, for example more than 30° C., the washing detergency of each of the conditions A and C becomes equal to each other.

Thus, the washing detergency of the washing processes can be increased by performing the second type washing process in addition to the first type washing process. In other words, the use of the second type washing process can increase the washing detergency of washing process by the drum type washing machine when the temperature of washing water is lower.

Embodiment 7

Figure 14:
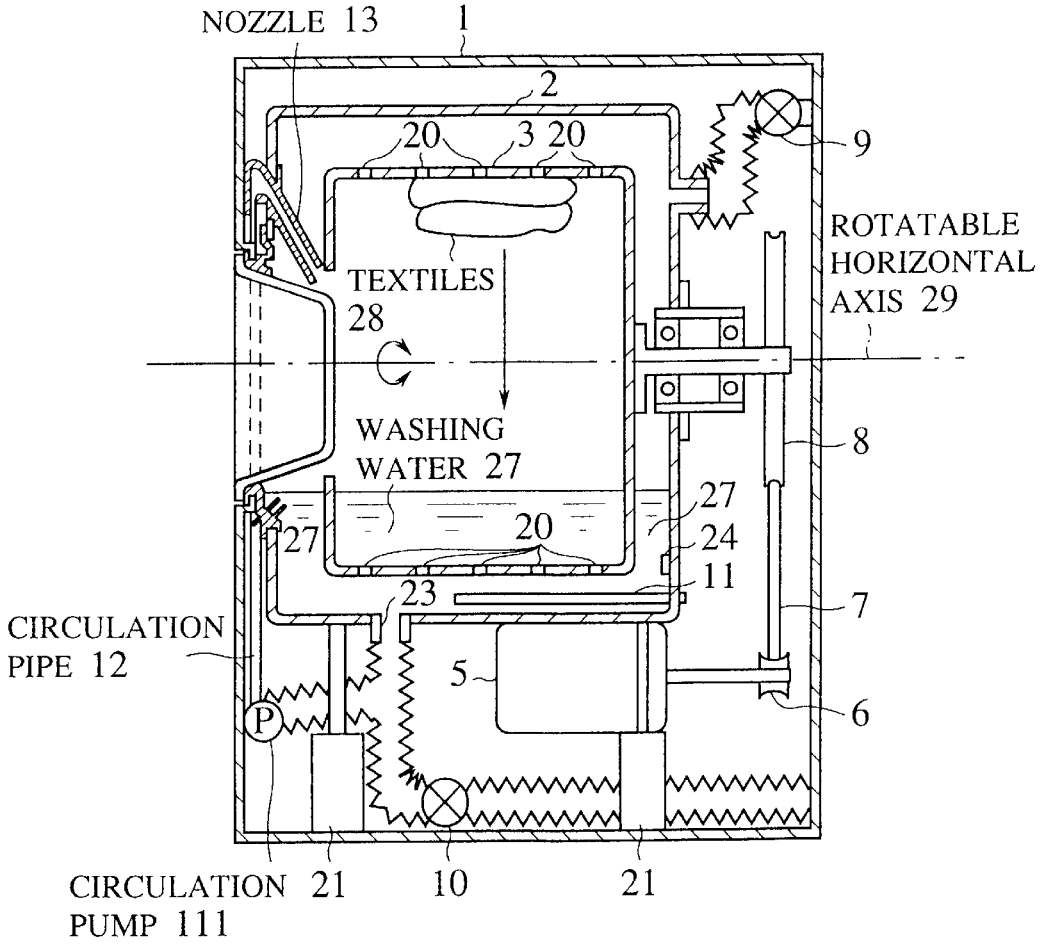
FIG. 14 is a sectional diagram showing a configuration of a drum type washing machine of the seventh embodiment of the present invention.

FIG. 14 is sectional diagram showing a configuration of a drum type washing machine of the seventh embodiment of the present invention. In the drum type washing machine of the seventh embodiment shown in FIG. 14, the drain pipe between the drain outlet 23 and the drain valve 10 is branched. The branched pipe from the drain pipe is connected to the pump or the circulation pump 111. In addition, the circulation pump 111 is further connected to a circulation pipe 12. The outlet of circulation pipe is connected to a nozzle 13. The nozzle 13 is connected to the drum-shaped spin basket 3 in the washing tub 2 in order to circulate the washing water 27 during the washing process. Namely, the circulated washing water is supplied to the drum-shaped spin basket 3 through the nozzle 13 located near the washing tub 2. Other components in the drum type washing machine of the seventh embodiment will be used with the same reference numbers in the drum type washing machine of the first embodiment as shown in FIGS. 1 and 2.

As shown in FIG. 14, the washing water 27 is circulated from the drain outlet 26 to the drum-shaped spin basket 3 through the circulation pipe 12 and the nozzle 13 by incorporating the circulation pump 111 under the control of the control circuit section 31.

Thus, the washing detergency of the washing process can be increased by circulating the washing water 27 under the control of the control circuit section 31.

FIG. 15 is a timing chart showing the operation of the drum type washing machine of the seventh embodiment shown in FIG. 14. As shown in (B) in FIG. 15, it is acceptable to circulate continuously the washing water 27 only during the second type washing process, or as shown in (C) in FIG. 15, it is also acceptable to circulate intermittently the washing water 27 during the second type washing process.

Furthermore, as shown in (D) in FIG. 15, it is also acceptable to circulate the washing water 27 after a predetermined time is elapsed counted from the completion of the second type washing process. In this case of (D) in FIG. 15, it can be reduced to generate sound or noise caused by scattering the washing water 27 and the textiles 28 pushed on the inner wall of the drum-shaped spin basket 3 which is caused in the second type washing process can be easily separated.

In addition, reference characters "E" and "F" shown in FIG. 15 designate control signals to control the drain valve 14 and the circulation pump 111, respectively.

Embodiment 8

Figure 16:
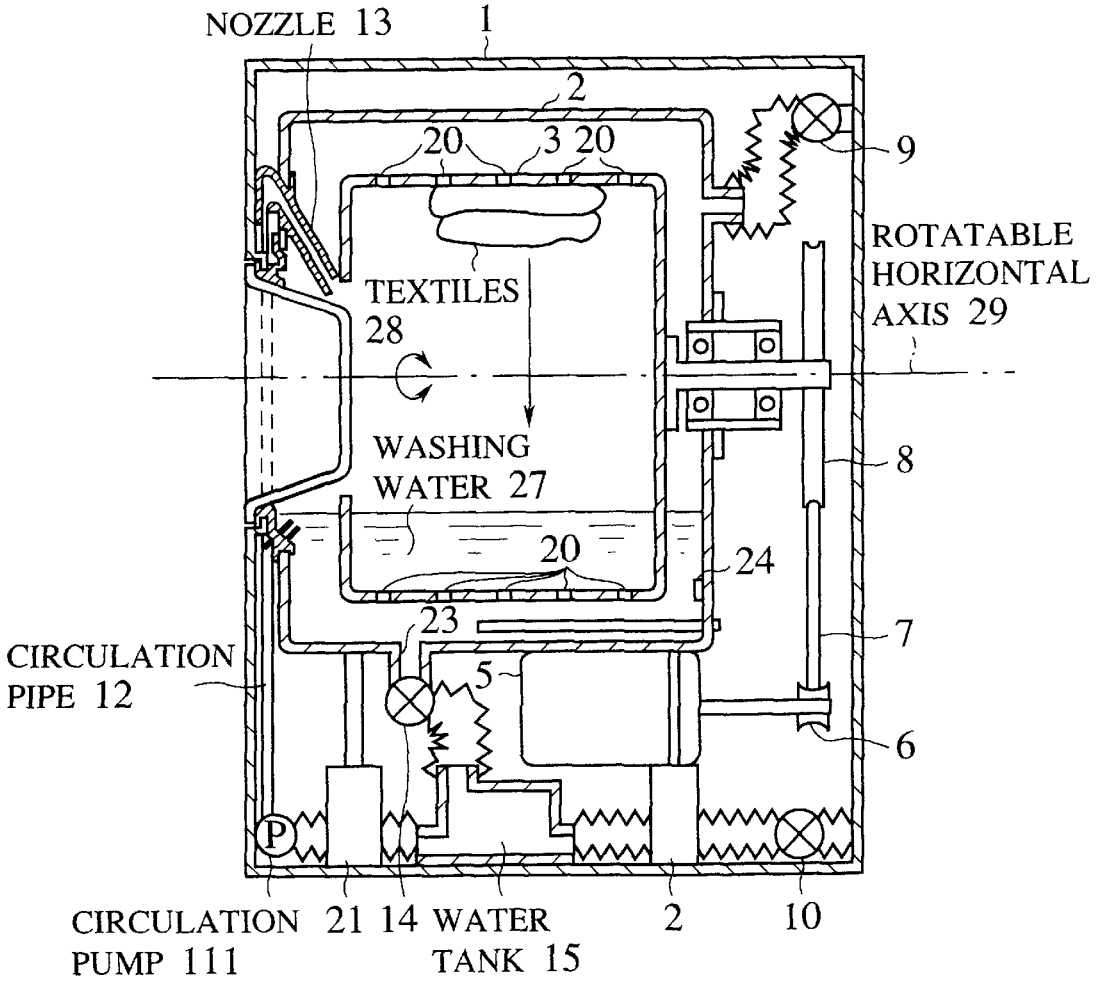
FIG. 16 is a sectional diagram showing a configuration of a drum type washing machine of the eighth embodiment of the present invention.

FIG. 16 is a sectional diagram showing a configuration of a drum type washing machine of the eighth embodiment of the present invention.

In the drum type washing machine of the eighth embodiment shown in FIG. 16, the drain valve 14 is placed directly below the drain outlet 23 and a water tank 15 to store temporary the washing water 27 for the second type washing process is incorporated. Other components of the drum type washing machine of the eighth embodiment are same in configuration and operation as those of the drum type washing machine of the seventh embodiment shown in FIG. 14. Therefore these explanations are omitted for concise explanation.

In the drum type washing machine of the eight embodiment, normally, the washing process is performed under the condition that the drain valve 14 is closed.

When the weight of the textiles 28 is more than 3 kg, it is required to use the washing water 27 of approximately 25 liters. In this case, the load of the motor 5 becomes heavy during the second type washing process. In order to reduce the heavy load to the pump 5 and in order to avoid the noise or sound and the vibration of the drum type washing machine caused by the execution of the second type washing process, part of the washing water 27 (for example, approximately 10 liters) in the washing tub 2 is transmitted to the water tank 15 before the start of the operation of the second type washing process after the completion of the first type washing process, as shown in (E) in FIG. 15 by opening the drain valve 14 under the control of the control circuit section 31.

Thereby, it can be eliminate to cause the noise and the vibration of the drum type washing machine during the second type washing process even if the amount of the textiles is large.

As shown in "F" in FIG. 15, the washing water stored in the water tank 15 is transmitted to the washing tub 2 by operating the circulation pump 111 after the completion of the second type washing process through the circulation pipe 12 and the nozzle 13 under the control of the control circuit section 31.

After the completion of the washing process, the drain valves 10 and 14 are open, so that the washing water stored in the water tank 15 and the washing water 27 in the washing tub 2 are drained to outside of the drum type washing machine. In the eighth embodiment, when the amount of the textiles 28 is not more than 3 Kg, the movement of the part of the washing water 27 to the water tank 5 is not performed. However, of course, as described above, the washing water 27 is circulated through the drain valve 14 and the water tank 15 in the circulation process even if the amount of the textiles 27 is not more than 3 Kg.

In addition, the operation that the drum-shaped spin basket 3 is rotated by a high rotation speed which is approximately equal to the rotation speed in the second type washing process can be used in the rinsing process during the washing process of the drum type washing machine of the all of the embodiments described above. Thereby, the washing detergency of the drum type washing machine can be increased. Namely, during the rinsing process, the washing water (used for the rinsing process) including the laundry detergent in the textiles 28 can be separated and dewatered into outside of the drum-shaped spin basket 3 through the small-sized holes 20 by spinning the drum-shaped spin basket 3 with a high rotation speed. Thereby, the required time period for the rinsing process can be decreased.

Figure 17:
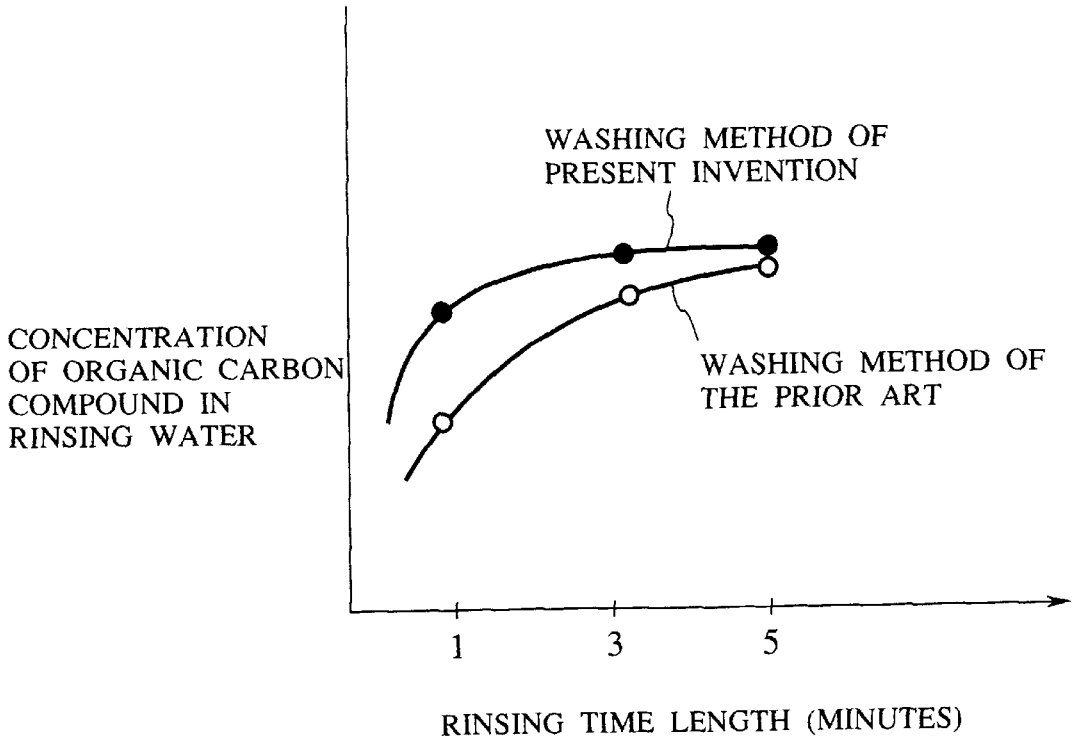
FIG. 17 is a diagram showing a comparison result of rinsing performance based on the change of concentration of organic carbon compound between the drum type washing machine of the eighth embodiment shown in FIG. 16 and a conventional drum type washing machine.

FIG. 17 is a diagram showing a comparison result of rinsing performance in the rinsing process based on the change of concentration of organic carbon compounds between the drum type washing machine of the eighth embodiment shown in FIG. 16 and a conventional drum type washing machine.

As clearly shown in FIG. 17, when comparing to the rinsing process used in the conventional drum type washing machine, the concentration of the organic carbon compounds in the rinsing water is saturated with a short time period in the rinsing process of the drum type washing machine of the eighth embodiment of the present invention. Therefore, the number of the rinsing process can be used when the method of the eighth embodiment of the present invention.

In addition, when a fresh water is used in the following rinsing process after the second rinsing process, the concentration or dilution of the laundry detergent in the fresh water in the washing tub 2 can be reduced when comparing the case of the prior art.

As described above in detail, the drum type washing machine of the present invention can increase the washing detergency when comparing to that of conventional drum type washing machines because the second type washing process in which washing water contained in textiles are separated and dewatered by centrifugal force generated by a high rotation speed after the completion of the first type washing process and because both the first type washing process and the second type washing process are repeated.

In addition, the drum type washing machine of the present invention can increase the washing detergency with a shot washing time period, because the drum-shaped spin basket is rotated during the second type washing process by more than a rotation speed with an angular speed by which washing water contained in textiles are dewatered to outside of the drum-shaped spin basket.

Moreover, the drum type washing machine of the present invention can increase the washing detergency with a shot washing time period when comparing to conventional drum type washing machines which perform only the first type washing process, because textiles are washed by the second type washing process in addition to the first type washing process.

Furthermore, the drum type washing machine of the present invention can obtain uniformly washing performance in spite of the change of the amount of textiles, because the rotation speed of the drum-shaped spin basket is changed and controlled based on the amount of the textiles which is detected by textile amount detection means during the second type washing process.

In addition, the drum type washing machine of the present invention can decrease noise or sound and vibration caused by the execution of the second type washing process, because the rotation speed of the drum-shaped spin basket is increased gradually during the second type washing process.

Furthermore, the drum type washing machine of the present invention can perform effectively the washing process and can obtain uniform washing detergency of the washing process based on season, a washing time in a day, a temperature of washing water, because the execution number of the second type washing process is changed based on the temperature of washing water in the washing tub.

Moreover, the drum type washing machine of the present invention can reduce vibration and sound caused by spattering washing water during the second type washing process, because the number of the execution of the second type washing process is reduced or the execution of the second type washing process is stopped when a detected temperature of the washing water is not less than a specified temperature.

In addition, the drum type washing machine of the present invention can increase washing detergency, because a washing water supply process and the second type washing process are executed continuously at the same time and thereby the washing water is circulated by circulation means during the second type washing process.

Further, the drum type washing machine of the present invention can reduce sound caused by spattering washing water in the washing tub, because the circulation of the washing water is performed intermittently under the control of control means.

Moreover, the drum type washing machine of the present invention can separate easily textiles pushed on the inner wall of the drum-shaped spin basket after the completion of the second type washing process, because the circulation of washing water is initiated after the predetermined time period counted from the start of the execution of the second type washing process is elapsed.

Furthermore, the drum type washing machine of the present invention can reduce sound caused by the rotation of the drum-shaped spin basket 3 and load of the motor for rotating the drum-shaped spin basket, because part of washing water in the washing tub is moved and stored temporarily into a water tank during the second type washing process.

In addition, the drum type washing machine of the present invention can distribute textiles in the drum-shaped spin basket, because the loosing process is performed before the start of the second type washing process and after the completion of the first type washing process.

Moreover, the drum type washing machine of the present invention can separate efficiently textiles from the inner wall of the drum-shaped spin basket, because the drum-shaped spin basket is rotated by a lower rotation speed which is lower than a predetermined rotation speed after the completion of the second type washing process.

Although the present invention has been described and illustrated in detail, it is clearly understood that the same is by way of illustration and example only and is not to be taken by way of limitation, the spirit and scope of the present invention being limited only by the term of the appended claims.

What is claimed is:

1. A drum type washing machine comprising:

a washing tub for storing fresh water or washing water where a laundry detergent can be dissolved;

a drum-shaped spin basket rotatably disposed in said washing tub, said drum-shaped spin basket being adapted to receive washing textiles to be cleaned, said drum-shaped spin basket having a plurality of small-sized holes, a part of said drum-shaped spin basket being adapted to be in contact with the washing water in said washing tub;

first type washing control means for controlling a first type washing operation during a predetermined period in which said textiles containing said washing water are fallen down into said washing water and onto an inner wall of said drum-shaped spin basket, while said drum-shaped spin basket is spinning;

second type washing control means for controlling a second type washing operation during a predetermined period in which said drum-shaped spin basket is spinning at a greater speed than in said first type washing operation to dewater said washing water contained in the textiles into said washing tub through said plurality of small-sized holes;

textile amount detection means for detecting an amount of said textiles in said drum-shaped spin basked; and rotation speed control means for indicating a change in the spinning speed of said drum-shaped spin basket from said first type washing operation to said second type washing operation based on said textile amount detected by the textile amount detection means.

2. A drum type washing machine as claimed in claim 1, further comprising:

rotation speed increasing means for gradually increasing the spinning speed of said drum-shaped spin basket from the spinning speed used in the first type washing operation up to the spinning speed used in the second type washing operation.

3. A drum type washing machine as claimed in claim 1, further comprising:

circulating means comprising at least a circulation pump and a circulation pipe for circulating said washing water from a bottom side of said washing tub to a top side of said washing tub; and circulation control means for controlling the operation of said circulation means so that said washing water is circulated by said circulating means during said second type washing operation.

4. A drum type washing machine as claimed in claim 3, further comprising:

intermittent control means for controlling said circulation control means so that said washing water is circulated intermittently.

5. A drum type washing machine as claimed in claim 4, further comprising:

circulation delay control means for controlling the operation of said circulation control means so that the circulation of said washing water is initiated after a predetermined time elapses from the start of said second type washing operation.

6. A drum type washing machine as claimed in claim 5, further comprising:

a supplementary tank for storing temporarily a part of said washing water in said washing tub; and washing water transfer control means for transferring part of the washing water in said washing tub into said supplementary tank in the second type washing operation by said second type washing control means.

7. A drum type washing machine as claimed in claim 1, further comprising:

a supplementary tank for storing temporarily a part of said washing water in said washing tub; and washing water transfer control means for transferring the part of the washing water in said washing tub into said supplementary tank in the second type washing operation by said second type washing control means.

8. A drum type washing machine comprising:

a washing tub for storing fresh water or washing water where a laundry detergent can be dissolved;

a drum-shaped spin basket rotatably disposed in said washing tub, said drum-shaped spin basket being adapted to receive washing textiles to be cleaned, said drum-shaped spin basket having a plurality of small-sized holes, a part of said drum-shaped spin basket being adapted to be in contact with the washing water in said washing tub;

first type washing control means for controlling a first type washing operation during a predetermined period in which said textiles containing said washing water are fallen down into said washing water and onto an inner wall of said drum-shaped spin basket, while said drum-shaped spin basket is spinning;

second type washing control means for controlling a second type washing operation during a predetermined period in which said drum-shaped spin basket is spinning at a greater speed than in said first type washing operation to dewater said washing water contained in the textiles into said washing tub through said plurality of small-sized holes; and rotation speed increasing means for gradually increasing the spinning speed of said drum-shaped spin basket from the spinning speed used in the first type washing operation up to the spinning speed used in the second type washing operation.

9. A drum type washing machine as claimed in claim 8, further comprising:

temperature detecting means for detecting a temperature of said washing water in said washing tub; and washing number changeable control means for changing the number of washing operations by said second type washing operation based on said temperature of said washing water detected by said temperature detection means.

10. A drum type washing machine comprising:

a washing tub for storing fresh water or washing water where a laundry detergent can be dissolved;

a drum-shaped spin basket rotatably disposed in said washing tub, said drum-shaped spin basket being adapted to receive washing textiles to be cleaned, said drum-shaped spin basket having a plurality of small-sized holes, a part of said drum-shaped spin basket being adapted to be in contact with the washing water in said washing tub;

first type washing control means for controlling a first type washing operation during a predetermined period in which said textiles containing said washing water are fallen down into said washing water and onto an inner wall of said drum-shaped spin basket, while said drum-shaped spin basket is spinning;

second type washing control means for controlling a second type washing operation during a predetermined period in which said drum-shaped spin basket is spinning at a greater speed than in said first type washing operation to dewater said washing water contained in the textiles into said washing tub through said plurality of small-sized holes;

temperature detection means for detecting a temperature of said washing water in said washing tub;

washing number changeable control means for changing the number of washing operations by said second type washing operation based on said temperature of said washing water detected by said temperature detection means; and washing number decreasing control means for decreasing the number of process performed by said second type washing operation when the temperature of the washing water is higher than a predetermined temperature or for performing the washing operation of said first type washing operation and for stopping said washing operation by said second type washing operation.

* * * * *

UNITED STATES PATENT AND TRADEMARK OFFICE

CERTIFICATE OF CORRECTION

PATENT NO. : 5,870,905

DATED : February 16, 1999

INVENTOR(S) : Fumihiro IMAMURA et al.

Figures 15A, 15B, 15C, 15D, 15E, 15F:
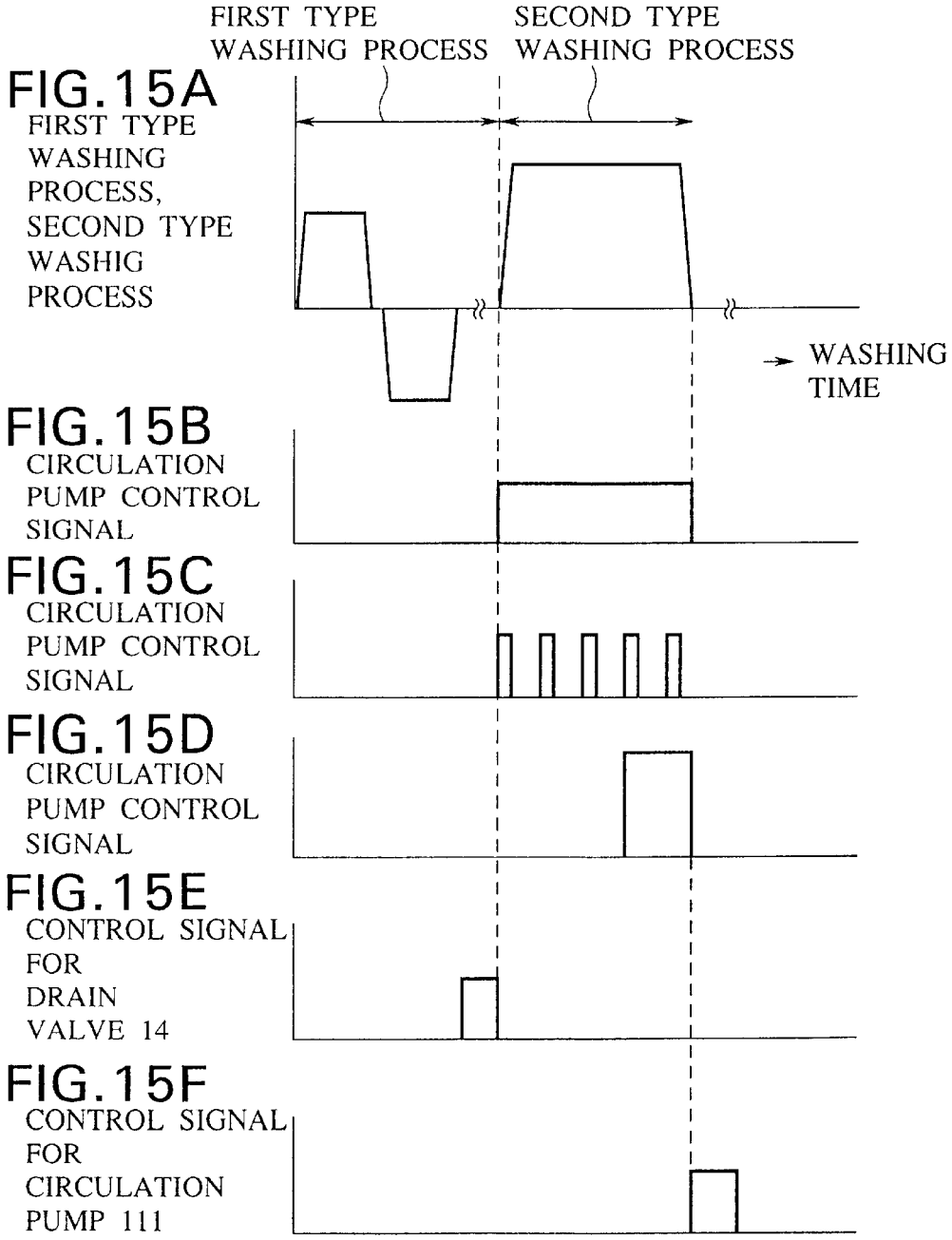
FIG. 15 is a timing chart showing the operation of the drum type washing machine of the seventh embodiment shown in FIG. 14.

It is certified that error appears in the above-identified patent and that said Letters Patent is hereby corrected as shown below:

Column 6, line 29 replace "FIG. 15 is a timing chart" with --FIGS. 15A-F are timing charts--.

Column 15, line 21 replace "FIG. 15 is a timing chart" with --FIGS. 15A-F are timing charts--;

line 23 replace "(B) in FIG. 15" with --FIG. 15B--;

line 26 replace "(C) in FIG. 15" with --FIG. 15C--;

lines 29 and 32 replace "(D) in FIG. 15" with --FIG. 15D--;

lines 8-9, replace "reference characters "E" and "F" shown in FIG. 15 designate" with --FIGS. 15E and 15F show--.

UNITED STATES PATENT AND TRADEMARK OFFICE

CERTIFICATE OF CORRECTION

PATENT NO. : 5,870,905

DATED : February 16, 1999

INVENTOR(S) : Fumihiro IMAMURA et al.

It is certified that error appears in the above-identified patent and that said Letters Patent is hereby corrected as shown below:

Column 16, line 5, replace "(E) in FIG. 15" with --FIG. 15E--.

line 2 replace " "F" in FIG. 15" with --FIG. 15F--.

Signed and Sealed this

Fourteenth Day of December, 1999

*Attest:*

Q. TODD DICKINSON

*Attesting Officer*

*Acting Commissioner of Patents and Trademarks*